United States Patent [19]

Pichelman et al.

[11] 4,336,624

[45] Jun. 29, 1982

[54] SQUEEGEE ASSEMBLY

[75] Inventors: Franklin D. Pichelman; Donald N. Mehl, both of Minnetonka, Minn.

[73] Assignee: Flo-Pac Corporation, Minneapolis, Minn.

[21] Appl. No.: 266,508

[22] Filed: May 22, 1981

Related U.S. Application Data

[63] Continuation of Ser. No. 99,706, Dec. 3, 1979, abandoned.

[51] Int. Cl.[3] ..... A47L 1/06

[52] U.S. Cl. ..... 15/245; 15/250.36

[58] Field of Search ..... 15/245, 250.36–250.42

[56] References Cited

U.S. PATENT DOCUMENTS

| | | | |
|---|---|---|---|
| 1,628,783 | 5/1927 | Jensen et al. | 15/245 |
| 1,828,139 | 10/1931 | Hawrylasz | 15/245 |
| 2,230,489 | 2/1941 | Grossfeld et al. | 15/245 |
| 2,797,428 | 7/1957 | Wallis | 15/250.36 |
| 2,901,762 | 9/1959 | Bell | 15/245 |
| 4,094,037 | 6/1978 | Karpp | 15/245 |

FOREIGN PATENT DOCUMENTS

| | | | |
|---|---|---|---|
| 749593 | 5/1956 | United Kingdom | 15/250.36 |
| 1062541 | 3/1967 | United Kingdom | 15/245 |

*Primary Examiner*—Peter Feldman

*Attorney, Agent, or Firm*—James R. Haller; Steven G. Parmelee

[57] ABSTRACT

A squeegee assembly having a tapered, flexible blade edge that will not develop a wary surface through use. The blade edge is formed on a flexible blade member, which blade member is disposed about and attached to another less flexible blade member. The flexible blade members may be symmetrically formed about a longitudinal axis, and the flexible blade member may include a blade edge formed on either side thereof. A blade support member having a shaped notch for receiving the flexible blade member provides longitudinal support therefor. The blade support member and flexible blade members are held and supported by a handle and trigger assembly having trigger actuated jaws.

2 Claims, 11 Drawing Figures

Fig. 1
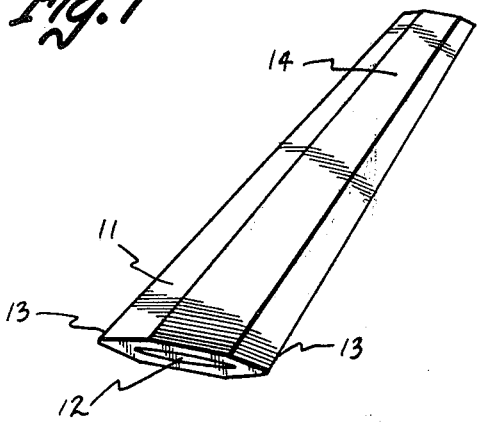
Fig. 3
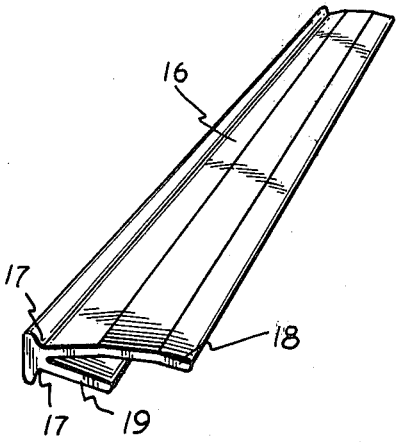
Fig. 2
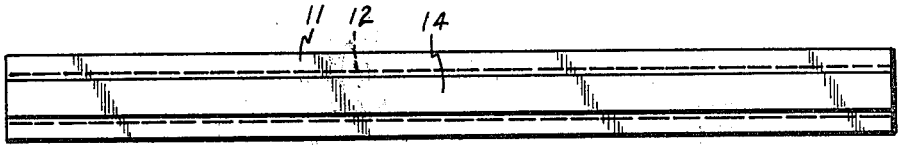
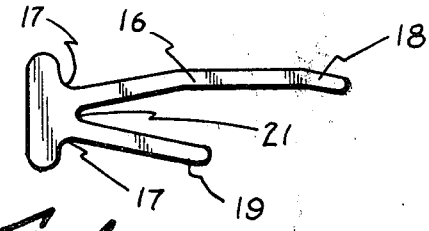
Fig. 4
Fig. 5
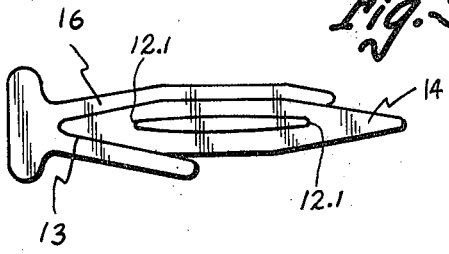

Fig. 6
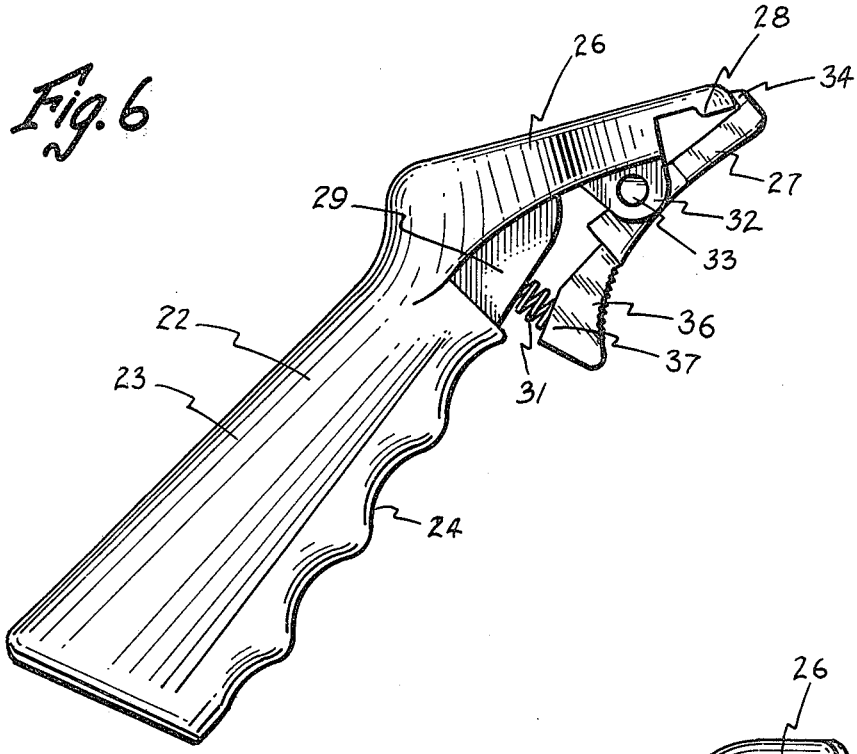
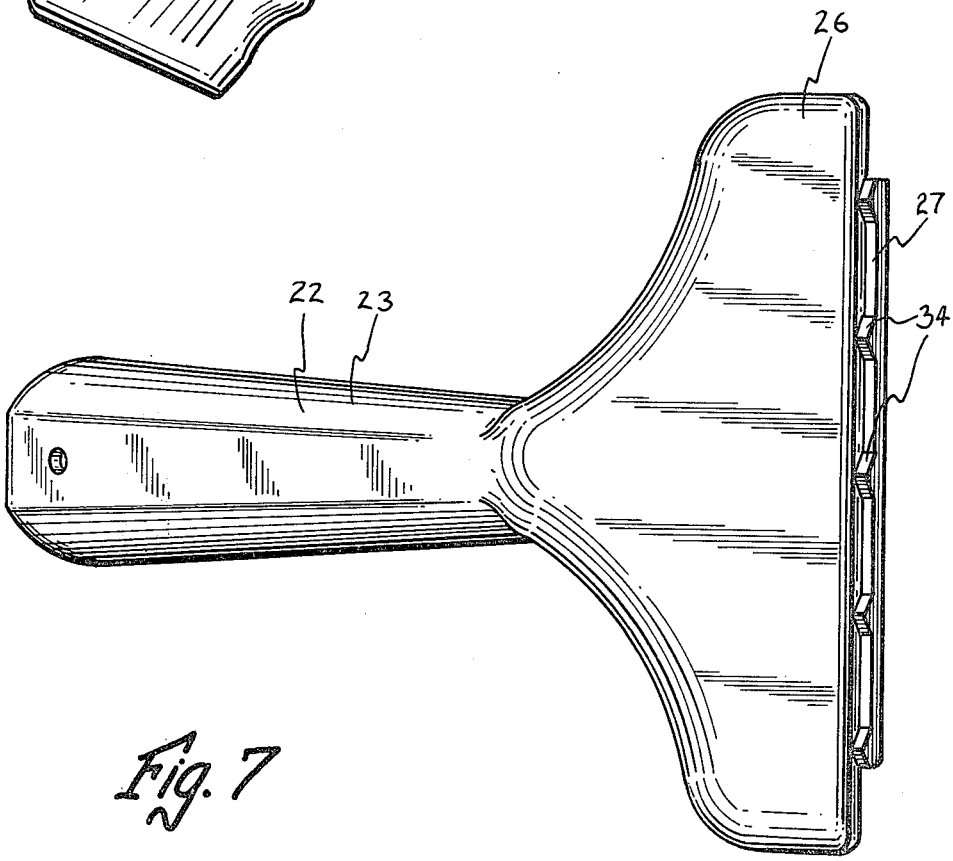
Fig. 7

SQUEEGEE ASSEMBLY

This application is a continuation of application Ser. No. 99,706, filed Dec. 3, 1979, now abandoned.

TECHNICAL FIELD

This invention relates generally to cleaning apparatus, and more particularly to squeegee assemblies and plastic extrusions.

BACKGROUND ART

Squeegees are generally used for removing excess liquids from glass surfaces, such as windows. They often consist of a hand-held unit having a flexible blade for contacting the glass surface. Such blades are usually made of rubber or a like substance, and excess liquids are removed by dragging the blade across the glass surface. Some of these squeegee assemblies are shown in U.S. Pat. Nos. 2,230,489; 2,440,099; 2,771,626; 2,905,960; and 3,892,005.

In previous squeegee assemblies, the blade edge will often become wavy through use of the blade for its intended purpose. This condition hampers the effectiveness of the squeegee, since the blade should be in close contact with the glass surface at all points along the length of the blade in order to properly remove all the excess liquid.

Therefore, a need exists for a squeegee assembly having a blade edge that will not develop a wavy surface through use.

DISCLOSURE OF INVENTION

The instant invention is directed towards a squeegee assembly that includes a tapered blade not significantly susceptible to developing a wavy surface. The assembly further includes a handle and trigger assembly suitable for use with this tapered blade.

The blade consists of a dual durometer plastic extruded member made of polyvinyl chloride or some like substance. This extruded member includes a flexible outer blade member and a less flexible inner blade member disposed within the outer blade member. Although both blade members may be constructed of a polyvinyl chloride such as 162 durometer No. 8812 Geon material as offered by the B. F. Goodrich Co., the outer blade member may be made more flexible than the inner blade member by introducing a greater amount of plasticizer into the outer blade material during the extrusion process.

To form the blade, both blade members are extruded simultaneously, with the inner blade member being extruded within the outer blade member. Both blade members are symmetrical about a central longitudinal axis, thereby forming two blade edges. Both blade edges of the outer blade member may be tapered.

The tapered edges of the outer blade member provide a very satisfactory and efficient squeegee blade edge, while the less flexible and more rigid inner blade member provides support to prevent the blade edges of the outer blade member from becoming wavy and therefore less effective.

The blade support member provides longitudinal support for the blade member and consists of an aluminum section having a lengthy upper lip and a shorter lower lip for disposition about the rearward portion of the blade member. The upper lip terminates proximal to the blade edge to provide support for the flexible blade edge when pressing the assembly against a glass surface. The shorter lip on the underside provides space for interacting with a gripping mechanism of the handle and trigger assembly.

The handle and trigger assembly includes a set of trigger actuated opposable jaws having dulled teeth on the lower jaw for gripping and holding the blade member and blade support member when those members are suitably disposed between the jaws. The assembly also includes a graspable appendage having a contoured surface for cooperative interaction with the human hand, such that the squeegee may be comfortably held and used by the operator.

To change blades, the operator need only squeeze the trigger actuated opposable jaws to release the blade. Upon removing the blade, a replacement may be inserted and the jaws allowed to close thereon.

BRIEF DESCRIPTION OF DRAWINGS

Other features of the instant invention may be more easily understood by reference to the following detailed description, and particularly when considered in view of the appended drawings, wherein:

FIG. 1 is a perspective view of the blade of the invention;

FIG. 2 is a top plan view of the blade depicted in FIG. 1;

FIG. 3 is a perspective view of the blade support member of the invention;

FIG. 4 is an enlarged side elevational view of the blade support member depicted in FIG. 3;

FIG. 5 is an enlarged side elevational view of the blade as inserted within the blade support member;

FIG. 6 is a side elevational view of the handle and trigger assembly of the invention;

FIG. 7 is an enlarged top plan view of the handle and trigger assembly of the invention;

BEST MODE FOR CARRYING OUT THE INVENTION

Figure 10:
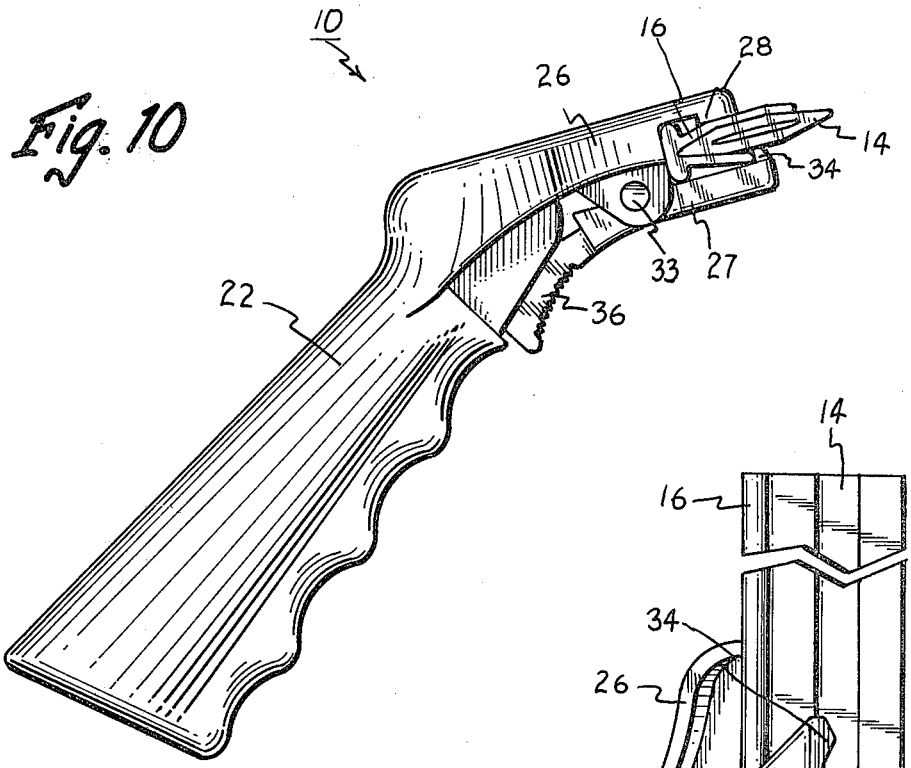
FIG. 10 is a side elevational view of the handle and trigger assembly with the blade and blade support member disposed between the opposable jaws.

Referring momentarily to FIG. 10, the apparatus of the invention is denoted generally by the numeral 10. The apparatus (10) includes generally blade means, blade support means, and handle and trigger means.

Referring now to FIGS. 1 and 2, the blade means are provided for by a first and second flexible blade member (11 and 12). The first blade member (11) comprises a flexible exterior material having a tapered edge (13) along both sides of its length. These tapered edges (13) form the blade edges intended for contact with the glass surface to be cleaned. The second blade member (12) consists of a less flexible blade member disposed within the first blade member (11) and being intimately connected therewith along the entire length thereof. The second blade member (12) has a tapered edge (12.1) along both sides of its length.

This configuration may be achieved by a dual durometer plastic extrusion process whereby the two blade members (11 and 12) are extruded simultaneously, with the first blade member (11) being extruded about the second blade member (12). Importantly, the extrusion process yields a blade having first and second blade members (11 and 12) so intimately associated as to effectively be an integral unit. That is, the second blade member (12) may not be removed from within or otherwise displaced with respect to the first blade member (11).

The applicant has found that this configuration results in a squeegee blade that may be used over an extended period of time with continuously favorable results. In particular, the tapered edges (13) operate easily and effectively to remove excess fluids from glass surfaces, and the less flexible second blade member (12) provides sufficient support such that the blade edges (13) will usually not develop a wavy surface.

Although the second blade member (12) provides support as described, the blade member as a unit (14) remains flexible. Blade support means may therefore be utilized to provide longitudinal support for the blade member (14) and to ensure proper interaction between the blade edge (13) and the glass surface. With reference to FIGS. 3 and 4, such blade support means are provided for by the blade support member (16) depicted. Although the blade support member (16) may be constructed of any suitable material, the applicant has determined that aluminum works well as it provides sufficient strength while contributing little to weight. Troughs (17) may be formed on both the upper and lower surfaces of the blade support member (16) as shown to further reduce weight.

The blade support member (16) includes a laterally extending upper lip (18) and lower lip (19) along its length. The upper lip (18) protrudes outwardly further than the lower lip (19). The upper and lower lips (18 and 19) define a notch (21) therebetween of a shape suitable for receiving the blade member (14) as shown in FIG. 5. Although the blade member (14) fits snugly within the blade support member (16), the blade member (14) may be easily removed therefrom. Because of the longitudinal symmetry of the blade member (14), either blade edge (13) may be fit within the notch (21) of the blade support member (16).

Referring now to FIGS. 6 and 7, the handle and trigger means are provided for by a handle and trigger assembly (22). Although the handle and trigger assembly (22) may be constructed of any suitable material, the applicant has determined that a formed plastic material works well. Being light of weight, the apparatus (10) may be used by the operator with less fatigue. Furthermore, by using a plastic material as versus a metal material, the apparatus (10) will not draw as much heat from the operator's hand, and will therefore contribute to the comfort of the operator in this regard as well.

The handle and trigger assembly (22) includes a grippable appendage (23) having a contoured surface (24) on its underside for comfortably conforming to the operator's hand.

At its upper end, the handle and trigger assembly (22) widens to form an upper jaw member (26) for operative juxtaposition vis-a-vis a lower jaw member (27) described below. The upper jaw member (26) includes a downwardly disposed spacing lip (28) for ensuring a sure fit about the blade support member (16).

The handle and trigger assembly (22) also includes a spring-receiving well (29) on its underside for receiving a trigger spring (31) and two downwardly oriented flanges (32) having holes disposed therethrough for receiving the pivot axle nodes (33) of the lower jaw member (27) to be described below.

The lower jaw member of the handle and trigger assembly (22) includes pivot axle nodes (33) formed on either side thereof for operable insertion in the holes provided therefore in the flanges (32) described above. The lower jaw member (27) also includes upwardly disposed dulled teeth (34) on its outer edge. The lower jaw member (27) terminates at its lower end in a shaped trigger surface (36) having a spring-receiving well (37) formed therein. As best shown in FIG. 6, a trigger spring (31) may be disposed within the trigger wells (29 and 37) formed in the trigger surface (36) and in the handle assembly. Being normally uncompressed, the trigger spring (31) will urge the lower jaw member (27) into a normally closed position with respect to the upper jaw member (26).

Figure 8:
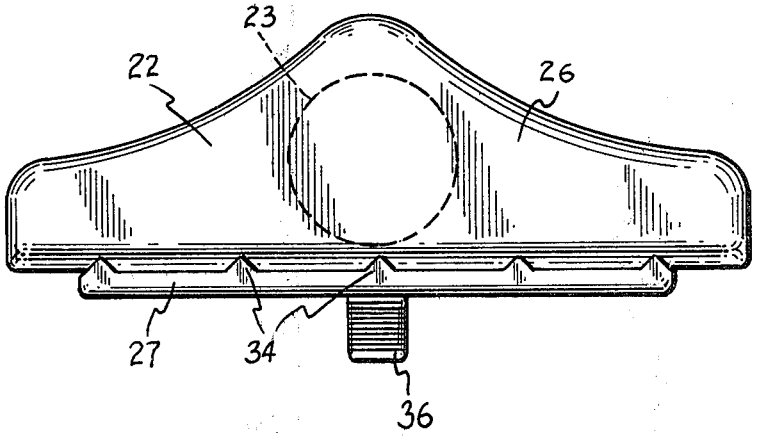
FIG. 8 is an enlarged front elevational view of the handle and trigger assembly with the opposable jaws in a closed position.
Figure 9:
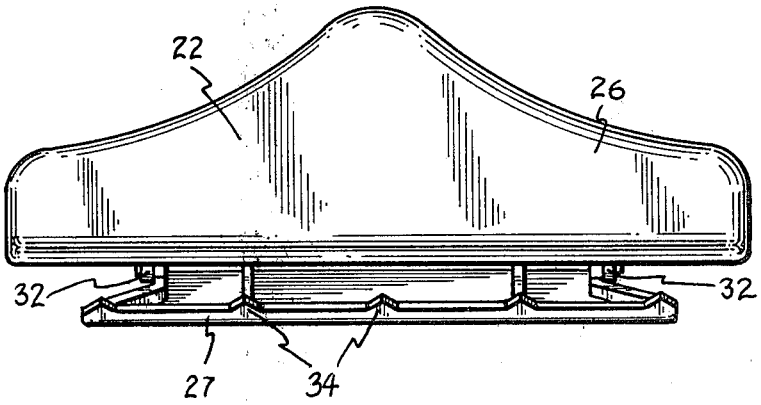
FIG. 9 is an enlarged front elevational view of the handle and trigger assembly of the invention with the opposable jaws in an open position.

Referring now to FIG. 8, the upper and lower jaw members (26 and 27) are depicted in the normally closed state. Upon urging the trigger surface (36) towards the handle assembly (22) and thereby pivoting the lower jaw member (27) about the pivot axle nodes (33), the lower jaw member (27) will be moved down and away from the upper jaw members (26), as depicted in FIG. 9.

With reference to FIG. 10, it may be seen that by opening the jaws, the blade member (14) and blade support member (16) may be inserted therein. When disposed between the jaws, the trigger surface (36) may be released, and the lower jaw member (27) will be urged towards the upper jaw member (26) by the trigger spring (31). The short length of the lower lip (19) of the blade support member (16) allows the teeth (34) of the lower jaw member (27) to become disposed thereabout and to come in operable contact with the blade member (14). Since the blade member (14) has an exterior surface made of an easily flexible material as disclosed above, the dulled teeth (34) will become engaged therewith and will grip and hold the blade member (14) and blade support member (16).

The applicant has determined that it may be desirable to locate the trigger surface (36) sufficiently close to the handle assembly (22) or to otherwise limit the opening of the jaws such that the lower jaw member (27) may only be moved a short distance from the upper jaw member (26). By so providing, the blade member (14) may be removed by pulling the blade member (14) out and away from the jaws. The blade support member (16), however, must be removed by sliding it out sideways since it would not then be removable over the teeth (34) of the lower jaw member (27). The operator will therefor incur less risk of inadvertently dropping the blade support member (16) from the apparatus (10) while changing or reversing the blade member (14).

INDUSTRIAL APPLICABILITY

Figure 11:
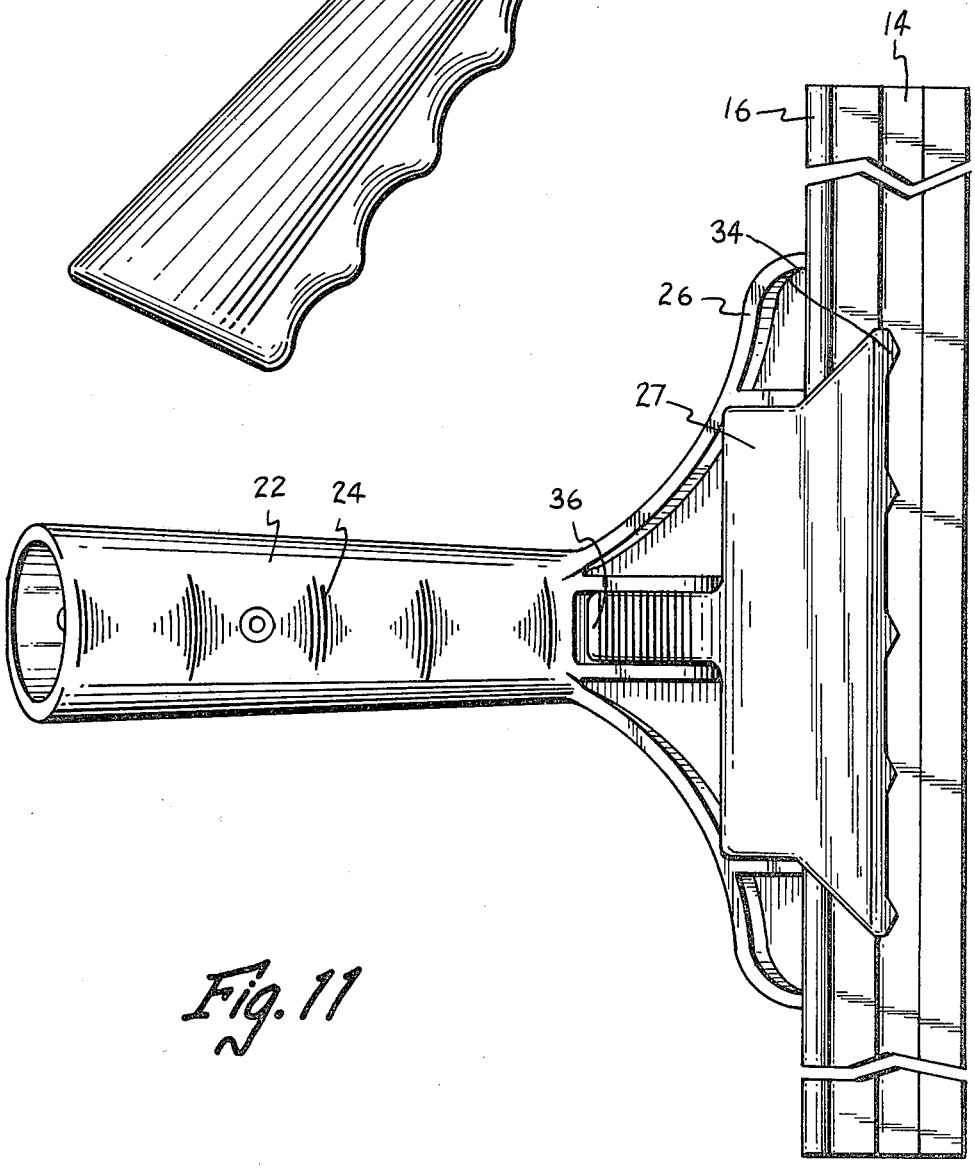
FIG. 11 is an enlarged bottom plan view of the apparatus as depicted in FIG. 10.

With reference to FIG. 11 and to the description above, it may be seen that the apparatus (10) provides for a tapered blade edge (13) highly effective in removing excess fluids from glass surfaces or the like. Importantly, this blade edge (13) will not develop a wavy surface through use and will therefore continue to be effective even after substantial use. Although the blade member (14) remains substantially flexible, a long blade edge (13) may be realized by use of a blade support member (16) that supports the blade member (14) along its length.

In use, the operator squeezes the trigger surface (36) to open the jaws. He then slips the blade support member (16) and blade member (14) between the jaws and allows the jaws to close by releasing the trigger surface (36). The operator may then use the apparatus (10) in the same manner that he would use most other squeegee assemblies. If the operator should decide that he wishes to exchange the blade edge (13), he need only squeeze the trigger (36) and remove the blade member (14). He may then either reverse the blade member (14) or insert a new blade member (14) and then reclose the jaws. Since the blade member (14) will not usually develop a permanent wavy surface through normal use, the blade member (14) should provide effective service over a significant period of time.

Many changes to the disclosed embodiment will be readily apparent to those skilled in the art. Therefore, while I have described the best mode known for carrying out the invention, it will be understood that various changes, adaptations, and modifications may be made therein without departing from the spirit of the invention and the scope of the appended claims.

What is claimed is:

1. A squeegee assembly comprising (a) blade means for providing a blade edge that is not significantly susceptible to developing a wavy surface, comprising:

(i) a first substantially flexible blade member having opposite substantially parallel longitudinal tapered edges; and (ii) a second flexible blade member substantially disposed symmetrically longitudinally around and permanently attached to said first blade member and having opposite tapered blade edges formed longitudinally thereon; and (b) handle means for supporting said blade means.

2. In a squeegee assembly, an improved dual durometer blade that is not significantly susceptible to developing a wavy surface, comprising:

(a) a plastic extruded core member; and (b) an exterior extruded member serving as a blade member, wherein:

(i) said extruded core member includes opposite substantially parallel longitudinal tapered edges; and (ii) said exterior extruded member is substantially disposed symmetrically longitudinally around about and is permanently attached to said extruded core member, and said exterior extruded member is comprised of material more flexible than the material comprising said core member, and said exterior extruded member includes at least one tapered blade edge formed longitudinally thereon.

* * * * *